US010483658B2

(12) United States Patent
Turner

(10) Patent No.: US 10,483,658 B2
(45) Date of Patent: Nov. 19, 2019

(54) WEIGHT REDUCED SWAGE PARALLEL GROOVE CLAMP

(71) Applicant: AFL Telecommunications LLC, Duncan, SC (US)

(72) Inventor: Kelvin Turner, Duncan, SC (US)

(73) Assignee: AFL Telecommunications LLC, Duncan, SC (US)

( * ) Notice: Subject to any disclaimer, the term of this patent is extended or adjusted under 35 U.S.C. 154(b) by 0 days.

(21) Appl. No.: 16/153,005

(22) Filed: Oct. 5, 2018

(65) Prior Publication Data

US 2019/0044255 A1 Feb. 7, 2019

Related U.S. Application Data

(63) Continuation of application No. 14/916,309, filed as application No. PCT/US2014/060812 on Oct. 16, 2014, now abandoned.

(60) Provisional application No. 61/891,740, filed on Oct. 16, 2013.

(51) Int. Cl.
*H01R 4/28* (2006.01)
*H01R 4/44* (2006.01)
*H01R 4/18* (2006.01)

(52) U.S. Cl.
CPC ..... *H01R 4/28* (2013.01); *H01R 4/18* (2013.01); *H01R 4/44* (2013.01)

(58) Field of Classification Search
CPC .. H01R 43/058; H01R 43/0585; H01R 4/186; Y10T 403/7141; F16G 11/02; B21D 39/048
See application file for complete search history.

(56) References Cited

U.S. PATENT DOCUMENTS 1,761,521 A * 6/1930 Eastman ..... H01R 43/058 72/402
2,938,069 A * 5/1960 Toedtman ..... H01R 4/186 174/71 R
3,221,532 A * 12/1965 Bazata ..... H01R 43/058 72/312
3,455,140 A * 7/1969 Smith ..... H01R 43/0585 72/416
3,848,451 A * 11/1974 Allin ..... B21D 39/046 72/402
3,916,517 A 11/1975 Luongo
3,958,300 A 5/1976 Tanaka
4,707,051 A 11/1987 Hall
5,323,697 A * 6/1994 Schrock ..... B21D 39/048 100/232
6,324,884 B1 * 12/2001 Barjesteh ..... B21D 39/046 29/237
6,519,998 B2 * 2/2003 Ertl ..... B21D 39/048 29/237
6,963,690 B1 11/2005 Kassal et al.
(Continued)

OTHER PUBLICATIONS

AFL Telecommunications LLC; International Patent Application No. PCT/US2014/060812; International Search Report; dated Mar. 19, 2015; (1 page).

*Primary Examiner* — Ross N Gushi
(74) *Attorney, Agent, or Firm* — Dority & Manning, P.A.

(57) ABSTRACT

Provided is a parallel groove clamp with a body; at least one tap configured to engage with a cable; and at least one indentation provided on outermost surface of the body.

17 Claims, 3 Drawing Sheets

(56) References Cited

U.S. PATENT DOCUMENTS

| | | | | |
|---|---|---|---|---|
| 7,043,806 | B2 * | 5/2006 | Schrock | B21D 39/048 29/237 |
| 7,143,626 | B2 * | 12/2006 | Dole | B21D 39/04 72/416 |
| 7,165,436 | B2 * | 1/2007 | Bitz | H01R 4/186 29/751 |
| 7,299,674 | B2 * | 11/2007 | Palejwala | B21D 39/048 29/237 |
| 8,230,714 | B2 * | 7/2012 | Intagliata | B21D 39/048 100/232 |
| 8,381,645 | B2 * | 2/2013 | Hejplik | B21D 39/048 100/269.01 |
| 9,085,023 | B2 * | 7/2015 | Danhash | B21D 39/04 |
| 9,166,353 | B1 * | 10/2015 | Doornbos | H01R 43/048 |
| 9,737,982 | B2 * | 8/2017 | Danhash | B25B 27/10 |
| 9,956,605 | B2 * | 5/2018 | Rao | B21J 13/03 |
| 9,979,151 | B2 * | 5/2018 | Loncar | B23P 11/005 |
| 10,243,313 | B2 * | 3/2019 | Dinh | H01R 43/058 |
| 2002/0056307 | A1 | 5/2002 | Ertl et al. | |

* cited by examiner

WEIGHT REDUCED SWAGE PARALLEL GROOVE CLAMP

CROSS-REFERENCE TO RELATED APPLICATIONS

This application is a continuation of U.S. patent application Ser. No. 14/916,309, filed on Mar. 3, 2016, which is a National Stage Patent Application of PCT/US2014/060812, filed on Oct. 16, 2014, which claims the benefit of priority to U.S. Provisional Patent Application No. 61/891,740, filed on Oct. 16, 2013, the disclosures of all of which are incorporated by reference herein in their entireties.

BACKGROUND OF THE INVENTION

1. Field of the Invention

Apparatuses and methods consistent with exemplary embodiments relate to a swage parallel groove clamp, and more particularly, to a swage parallel groove clamp including an external channel/indentation for overall weight reduction.

2. Background

In the related art, a pre-press clamp with a cylindrical cross-sectional shape with two holes in the center is typically used as a parallel groove (PG) clamp. After two cables are inserted into the respective holes of the clamp, a radial swage press apparatus crimps the clamp until a solid cross section exists without any gaps between clamp and the cables. However, in the end product of the clamp and the cables, there is excessive copper in the parallel groove clamp product because the pre-press clamp having the cylindrical cross-sectional shape is generally required to work on the radial swage press apparatus. Therefore, there is room for improvement of overall weight reduction of the parallel groove clamp product.

BRIEF SUMMARY OF THE INVENTION

Exemplary implementations of the present invention address at least the issues described above and the objects described below. Also, the present invention is not required to address the issues described above or objects described below, and an exemplary implementation of the present invention may not address the issues listed above or objects described below.

Additional aspects will be set forth in part in the description which follows and, in part, will be apparent from the description, or may be learned by practice of the presented exemplary embodiments.

An object of the invention is to reduce the amount of material needed for a swage PG damp.

According to an aspect of an exemplary embodiment, there is provided a parallel groove clamp including: a body; at least one tap configured to engage with a cable; and at least one indentation provided on outermost surface of the body.

The at least one indentation may be provided along an entire axial length of the body.

The least one indentation may include a concave shape.

The at least one tap is provided inside the body.

According to an aspect of another exemplary embodiment, there is provided a radial swage press apparatus including: an apparatus body; a yoke provided on the apparatus body; a die block provided on the apparatus body; a die provided between the yoke and die block; and a die insert provided between at least one of the yoke and die block and a parallel groove clamp inserted into the apparatus, wherein an innermost surface of the die insert corresponds to a shape of an indentation of the parallel groove clamp inserted into the apparatus.

The indentation may include a concave shape.

BRIEF DESCRIPTION OF THE DRAWINGS

The above and other objects, features and advantages of the invention will become more apparent by describing in detail exemplary embodiments thereof with reference to the attached drawings in which.

DETAILED DESCRIPTION OF EXEMPLARY EMBODIMENTS OF THE INVENTION

Figure 1A:
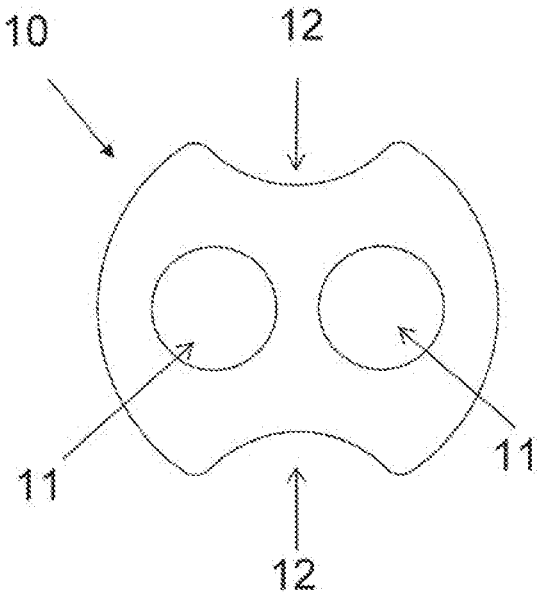
FIG. 1A illustrates a cross-sectional view of a pre-installation swage parallel groove (PG) clamp according to an exemplary embodiment.

As the current inventive concept allows for various changes and numerous exemplary embodiments, particular exemplary embodiments will be illustrated in the drawings and described in detail in the written description. However, this is not intended to limit the inventive concept to particular modes of practice, and it is to be appreciated that all changes, equivalents, and substitutes that do not depart from the spirit and technical scope of the inventive concept are encompassed. Although different exemplary embodiments are illustrated for description of the present invention, like reference numerals in the drawings denote like elements While such terms as "first", "second", etc., may be used to describe various components, such components must not be limited to the above terms. The above terms are used only to distinguish one component from another.

The terms used in the present specification are merely used to describe particular embodiments, and are not intended to limit the present invention, An expression used in the singular encompasses the expression of the plural, unless it has a clearly different meaning in the context. In the present specification, it is to be understood that the terms such as "including", "having", and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Figure 1B:
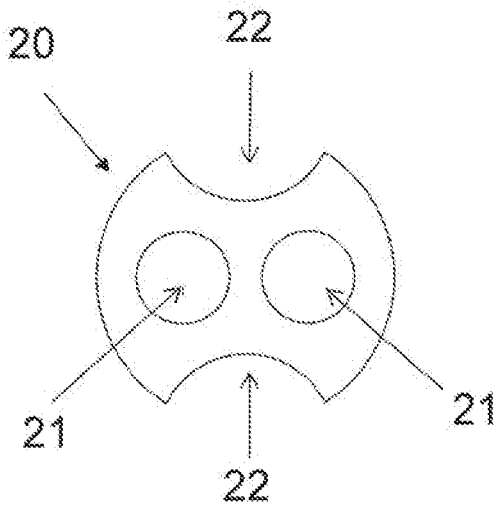
FIG. 1B illustrates a cross-sectional view of an installation swage PG clamp according to an exemplary embodiment.

FIG. 1A illustrates a cross-sectional view of a pre-installation swage parallel groove (PG) clamp 10 according to an exemplary embodiment. FIG. 1B illustrates a cross-sectional view of an installation swage PG clamp 20 according to an exemplary embodiment. As will be described below, the installation swage PG clamp 20 may be produced after the pre-installation swage PG clamp 10 is crimped by a radial swage press apparatus 100 (See FIGS. 2A-2C). Referring back to FIG. 1A, the pre-installation swage PG clamp 10 may include a pair of taps 11 into which a copper cable 30 may be inserted. The exemplary embodiment shown in FIG. 1A includes two taps for inserting the copper cable 30. However, the exemplary embodiment is not limited thereto. For example, the pre-installation swage PG clamp 10 may include a single tap fora cable or the pre-installation swage PG clamp 10 may include three or more taps for a plurality of cables. Further, different types of cables may be used. For example, steel or aluminum cables also may be used.

The pre-installation swage PG clamp 10 made be made up of copper (Cu) or aluminum (Al) or other suitable compressible metals.

The pre-installation swage PG clamp 10 includes a pair of indentations 12 on an outermost surface of the pre-installation swage PG clamp 10. As shown in FIG. 1A, each of the pair of indentations 12 has a concave shape. The pair of indentations 12 may be provided as a build-of-material or may be machined in before the crimping the pre-installation swage PG clamp 10 to form the installation swage PG clamp 20. The exemplary embodiment shown in FIG. 1A includes the indentations 12 as facing each other. However, the exemplary embodiment is not limited thereto. For example, the pre-installation swage PG clamp 10 may include a single indentation 12 for weight reduction or three or more indentations 12 according to the designer intent and the desired weight of the installation swage PG clamp 20.

Further, the locations of the indentations 12 are not limited. As long as the outer surface of the taps 11 and the indentations 12 are sufficiently provided apart from each other, the locations of the indentations 12 along the outer surface of the pre-installation swage PG clamp 10 are not limited. Even further, the shape of the indentations 12 is not particularly limited. For example, the indentations 12 may have a polygonal cross-sectional area or any curved shape. The shape of the indentations 12 may be determined based on the desired weight of the installation swage PG clamp 20 and the consideration for stress concentration based on the shape of the indentations 12.

FIG. 1B illustrates the installation swage. PG clamp 20 which is produced after the pre-installation swage PG clamp 10 is crimped by radial swage press apparatus 100. Similar to the pre-installation swage PG clamp 10, the installation swage PG clamp 20 may include a pair of taps 21 corresponding to the pair of taps 11 of the pre-installation swage PG clamp 10 after the crimping and a pair of indentations 22 corresponding to the pair of indentations of the pre-installation swage PG clamp 10 after the crimping. As shown in FIG. 1B, the overall shape of the installation swage PG clamp 20 remain similar to the pre-installation swage PG clamp 10. However, the overall size of the installation swage PG clamp 20 including the pair of taps 21 and the pair of indentations 22 decreases due to the crimping. After the crimping, the cables 30 arc tightly held within the pair of taps 21 and there is no gap between the cables and the taps 21.

Figure 2A:
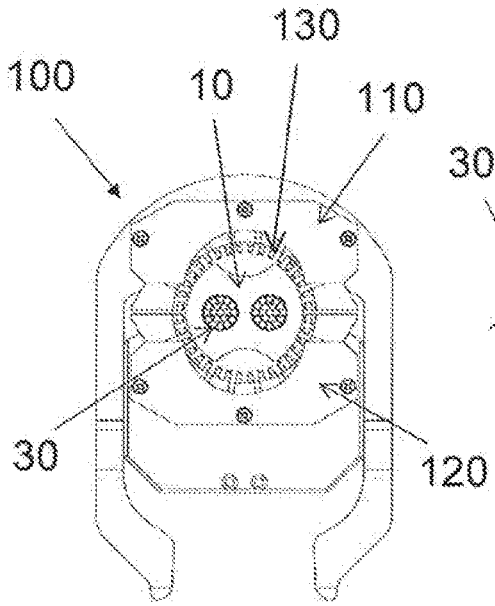
FIGS. 2A, 2B and 2C illustrate a front, side and cross-sectional view of a radial swage press apparatus along with a pre-installation swage PG clamp and cables according to an exemplary embodiment.
Figure 2B:
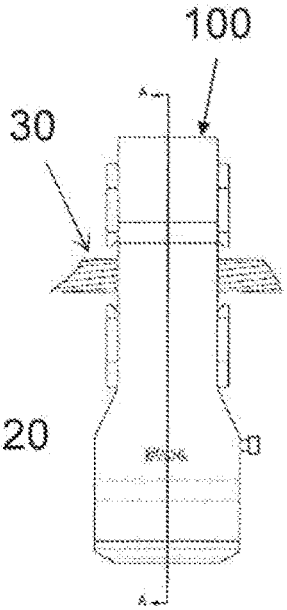
Figure 2C:
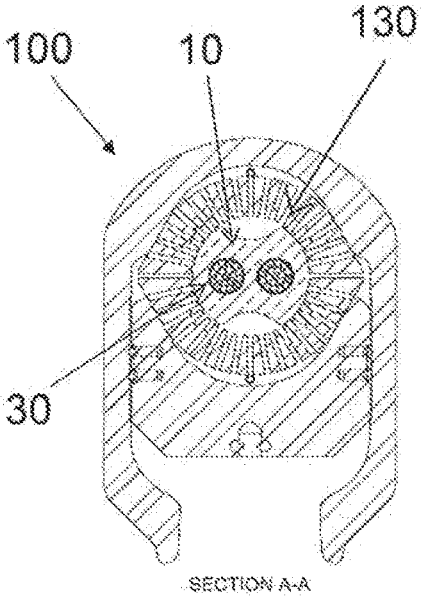

FIGS. 2A, 2B and 2C illustrate a front, side and cross-sectional view of a radial swage press apparatus 100 along with a pit-installation swage PG clamp 10 and cables 30 according to an exemplary embodiment. According to the exemplary embodiment, the radial swage press apparatus 100 includes a yoke/head 110 and a die block 120 which together crimp the pre-installation swage PG clamp 10 to produce the installation swage PG clamp 20 as shown in FIG. 1B. Inside each of the yoke/head and die block 110, 120 in a radial direction, a die 130 having a circular shape is provided between the yoke/head and die block 110, 120 and the pre-installation swage PG clamp 10. During the crimping, the circumference of the die 130 may be pressed and the die 130 crimps the pre-installation swage PG clamp 10 into the installation swage PG clamp 20.

Figure 3A:
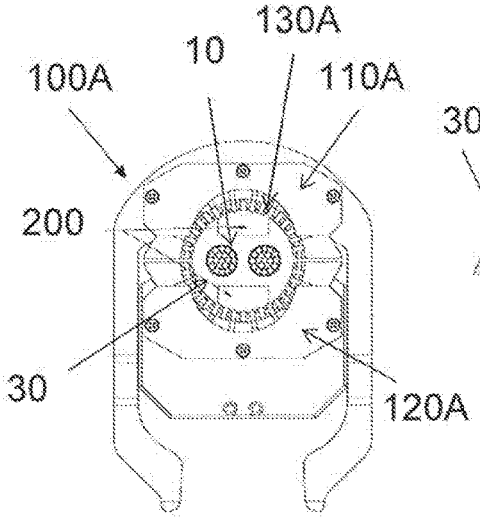
FIGS. 3A, 3B and 3C illustrate a front, side and cross-sectional view of a radial swage press apparatus along with a pre-installation swage PG clamp and cables according to another exemplary embodiment.
Figure 3B:
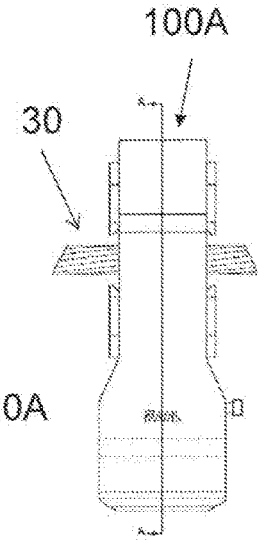
Figure 3C:
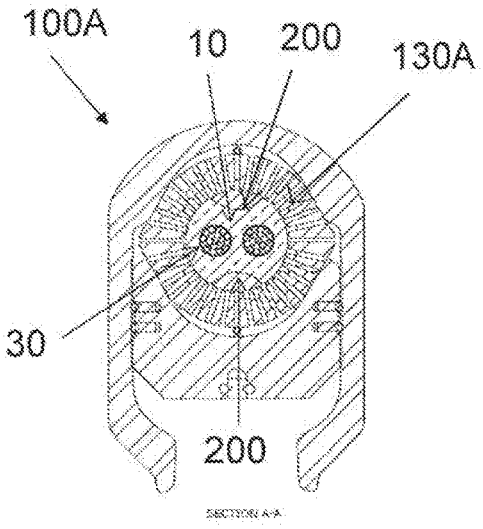
Figure 4:
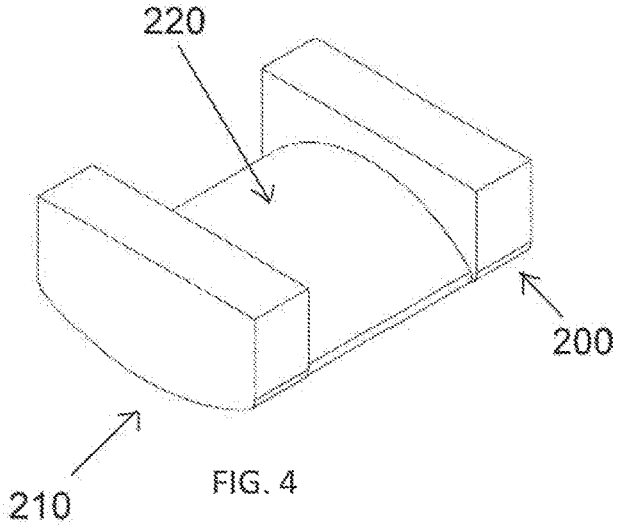
FIG. 4 illustrates a die insert which may be inserted into a radial swage press apparatus.

FIGS. 3A, 3B and 3C illustrate a front, side and cross-sectional view of a radial swage press apparatus 100A along with a pre-installation swage PG clamp 10 and cables 30 according to another exemplary embodiment. FIG. 4 illustrates a die insert 200 which may be inserted into the radial swage press apparatus 100A. According to the exemplary embodiment, the radial swage press apparatus 100A includes a yoke/head 110A and a die block 120A which together crimp the pre-installation swage PG clamp 10 to produce the installation swage PG clamp 20 as shown in FIG. 1B. Inside each of the yoke/head and die block 110A, 120A in a radial direction, a die 130 having a circular shape is provided between the yoke/head and die block 110A, 120A and the pre-installation swage PG clamp 10. During the crimping, the circumference of the die 130 may be pressed and the die 130 crimps the pm-installation swage PG clamp 10 into the installation swage PG clamp 20.

In the present exemplary embodiment, in addition to the die 130, the die insert 200 may be provided between the die 130 and the pre-installation swage PG clamp 10. Referring to FIG. 4, the die insert 200 may include an outer surface 210 having a shape corresponding to an inner surface of the die 130 and an inner surface 220 having a shape corresponding to the outer surface of the indentations 22 of the installation swage PG clamp 10.

Referring to FIGS. 3A, 38 and 3C, the die insert 200 is placed on both sides of the clamp 10. The inner surface 220 matches the shape of the indentation 22. The matching the inner surface 220 and the indentation 22 forces the indentation 12 to form into the indentations 22 during the crimping process. When the indentation 22 is shaped, it forces the material to the center which crimps the cable.

EXAMPLE

A PG clamp for two (2) 250 MCM copper cables have been manufactured using a conventional pre-installation PG clamp and a pre-installation PG clamp according to exemplary embodiments of the instant Application. The results have shown that the weight-reduced design according to the exemplary embodiments provide at least 20% in weight reduction from the conventional pm-installation PG clamp.

According to the exemplary embodiments disclosed above, one will be able to reduce the amount of material needed for a swage PG clamp. Further, the process of producing the swage PG clamp may be enhanced by using a reusable die insert.

While the invention has been particularly shown and described with reference to exemplary embodiments thereof, the invention is not limited to these embodiments. It will be understood by those of ordinary skill in the art that various changes in form and details may be made therein without departing from the spirit and scope of the invention as defined by the following claims.

What is claimed is:

1. A method for installing a clamp, the method comprising:

inserting at least one cable into at least one tap of the clamp, the clamp having a pre-installation size and including a body, the at least one tap defined in the body, and at least one indentation defined in an outermost surface of the body;

providing the clamp into a radial swage press apparatus, the radial swage press apparatus comprising a yoke, a die block, a die disposed between the yoke and the die block, and at least one die insert, the at least one die insert having an inner surface which corresponds to a shape of the at least one indentation;

crimping the clamp with the radial swage press apparatus such that the resulting crimped clamp has an installation size which is less than the pre-installation size and includes the body, the at least one tap, and the at least one indentation.

2. The method of claim 1, wherein the at least one tap is a plurality of taps.

3. The method of claim 2, wherein the plurality of taps is two parallel taps.

4. The method of claim 1, wherein the indentation is a plurality of indentations.

5. The method of claim 4, wherein the plurality of indentations is two opposing indentations.

6. The method of claim 1, wherein the indentation has a concave shape.

7. The method of claim 1, wherein after crimping the at least one cable is held tightly within the at least one tap such that there is no gap between the at least one cable and the at least one tap.

8. The method of claim 1, wherein the die has a circular shape.

9. The method of claim 1, wherein the at least one die insert is a plurality of die inserts.

10. The method of claim 1, wherein the clamp is formed from one of copper or aluminum.

11. A method for installing a clamp, the method comprising:

inserting a cable into each of a plurality of taps of the clamp, the clamp having a pre-installation size and including a body, the plurality of taps defined in the body, and a plurality of indentations defined in an outermost surface of the body;

providing the clamp into a radial swage press apparatus, the radial swage press apparatus comprising a yoke, a die block, a die disposed between the yoke and the die block, and a plurality of die inserts, each die insert of the plurality of die inserts having an inner surface which corresponds to a respective one of the plurality of indentations;

crimping the clamp with the radial swage press apparatus such that the resulting crimped clamp has an installation size which is less than the pre-installation size and includes the body, the plurality of taps, and the plurality of indentations.

12. The method of claim 11, wherein the plurality of taps is two parallel taps.

13. The method of claim 11, wherein the plurality of indentations is two opposing indentations.

14. The method of claim 11, wherein each of the plurality of indentations has a concave shape.

15. The method of claim 11, wherein after crimping each cable is held tightly within one of the plurality of taps such that there is no gap between the cable and the one of the plurality of taps.

16. The method of claim 11, wherein the die has a circular shape.

17. The method of claim 11, wherein the clamp is formed from one of copper or aluminum.

* * * * *